US009200476B2

(12) United States Patent
Yan et al.

(10) Patent No.: US 9,200,476 B2
(45) Date of Patent: Dec. 1, 2015

(54) HANDLE LOCKING DEVICE FOR MODULARIZED TERMINAL ELECTRIC APPLIANCE

(75) Inventors: Gang Yan, Shanghai (CN); Pengbin Yan, Shanghai (CN)

(73) Assignee: NOARK ELECTRICS (SHANGHAI) CO., LTD. (CN)

( * ) Notice: Subject to any disclaimer, the term of this patent is extended or adjusted under 35 U.S.C. 154(b) by 29 days.

(21) Appl. No.: 14/355,494

(22) PCT Filed: Jan. 12, 2012

(86) PCT No.: PCT/CN2012/070282

§ 371 (c)(1),
(2), (4) Date: Apr. 30, 2014

(87) PCT Pub. No.: WO2013/063875

PCT Pub. Date: May 10, 2013

(65) Prior Publication Data

US 2014/0283566 A1 Sep. 25, 2014

(30) Foreign Application Priority Data

Nov. 3, 2011 (CN) ..... 2011 1 0344236

(51) Int. Cl.
*H01H 19/28* (2006.01)
*E05B 65/00* (2006.01)
*H01H 9/28* (2006.01)

(52) U.S. Cl.
CPC ..... *E05B 65/0089* (2013.01); *H01H 9/282* (2013.01); *H01H 9/283* (2013.01); *H01H 9/286* (2013.01); *H01H 19/28* (2013.01); *Y10T 70/5757* (2015.04)

(58) Field of Classification Search
CPC ..... H01H 9/283; H01H 9/286; H01H 9/282; H01H 19/28; E05B 65/0089; Y10T 70/5757
USPC ..... 200/43.01, 43.11–43.16, 43.19, 43.22, 200/329–339; 70/207
See application file for complete search history.

(56) References Cited

U.S. PATENT DOCUMENTS 1,910,205 A * 5/1933 Frank ..... 200/335
4,107,488 A * 8/1978 Keller et al. ..... 200/50.15

(Continued)

FOREIGN PATENT DOCUMENTS

CN 101645377 2/2010
CN 202307610 7/2012

OTHER PUBLICATIONS

International Search Report dated Aug. 16, 2012 issued in corresponding International patent application No. PCT/CN2012/070282.

*Primary Examiner* — Edwin A. Leon
(74) *Attorney, Agent, or Firm* — Ostrolenk Faber LLP

(57) ABSTRACT

A handle locking device for a modularized terminal electric appliance is presented. A housing base thereof can be assembled onto any outer side surface of the housing of an appliance through a connection mechanism. There are a horizontal pivoting door and a vertical pivoting door which can be unfolded or folded inside a door hole on a sliding member of the locking mechanism. When unfolded, the horizontal pivoting door mates with an appliance handle to block the reverse motion of the handle, and the vertical pivoting door and the horizontal pivoting door can mate to block the reverse motion of the unfolded horizontal pivoting door. The horizontal pivoting door is pivotally connected to the sliding member through a horizontal pivoting, and the vertical pivoting door is pivotally connected to the sliding member through a vertical pivoting. A padlock is provided with a lock ring which can penetrate the interconnected door hole from a padlock hole and the lock ring can mate with the vertical pivoting door to block the reverse motion of the unfolded vertical pivoting door. The locking mechanism is connected and mounted with the housing base through a moving pair and can only perform up/down sliding along the direction of an assembly reference line B parallel to the appliance height direction Y, the locking mechanism is defined to slide merely between the locking and unlocking positions thereof, and adjustable height position of the locking device under the two states of handle locking and unlocking is realized by way of the shift of the sliding member.

10 Claims, 7 Drawing Sheets

(56) References Cited

U.S. PATENT DOCUMENTS

| | | | | |
|---|---|---|---|---|
| 4,612,424 | A * | 9/1986 | Clark et al. | 200/50.18 |
| 6,940,027 | B1 | 9/2005 | Sipe | |
| 6,989,499 | B2 * | 1/2006 | Bortolloni et al. | 200/50.05 |
| 7,355,132 | B1 | 4/2008 | Rezac et al. | |
| 2008/0277250 | A1 | 11/2008 | DeCook et al. | |
| 2014/0262702 | A1 * | 9/2014 | Oley et al. | 200/43.11 |

* cited by examiner

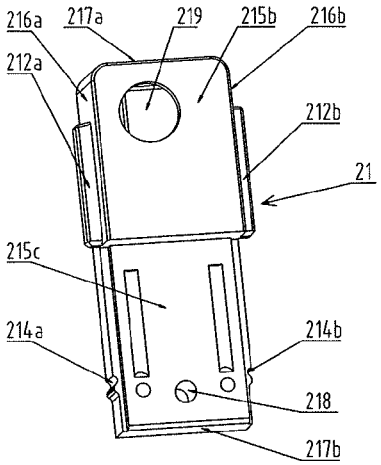
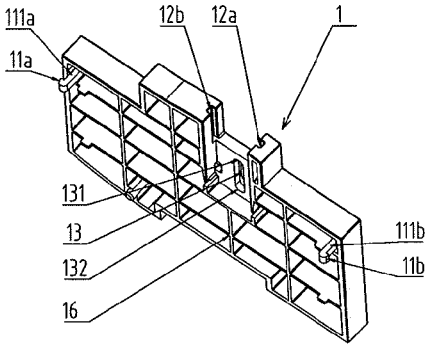
FIG.14 FIG.15
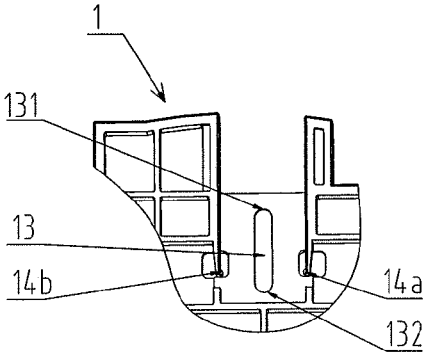
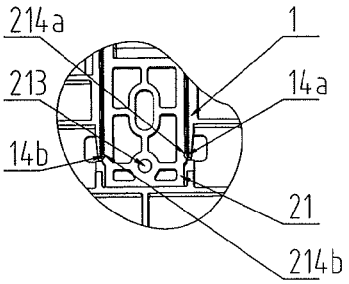
FIG.16 FIG.17
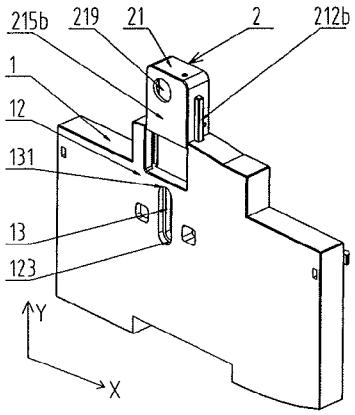
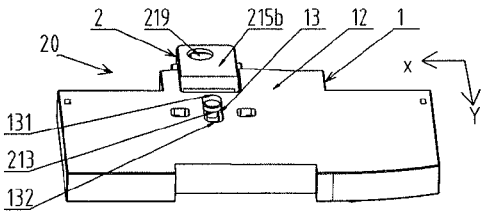
FIG.18 FIG.19

HANDLE LOCKING DEVICE FOR MODULARIZED TERMINAL ELECTRIC APPLIANCE

CROSS REFERENCE TO RELATED APPLICATIONS

The present application is a 35 U.S.C. §371 National Phase conversion of PCT/CN2012/070282, filed Jan. 12, 2012, which claims benefit of Chinese Application No. 201110344236.3, filed Nov. 3, 2011, the disclosure of which is incorporated herein by reference. The PCT International Application was published in the Chinese language.

TECHNICAL FIELD

The present invention relates to a handle locking device for a modularized terminal electric appliance, in particular to an operation handle locking device for a modularized terminal circuit breaker (hereinafter referred to as breaker), which achieves locking for the handle of the breaker when the handle or electrical circuit of the breaker is at an OFF position, in order to prevent manual closing operation on the handle of the breaker.

BACKGROUND

In a power distribution system, a modularized terminal electric appliance based mainly on a low-voltage breaker is mostly and widely used, and it has the functions of not only controlling ON/OFF of main circuit or equipment, but also applying overload, short-circuit and over-voltage protection on main circuit or equipment. OFF state locking function has become one of the most common and important functions in power management and safety management as the standard of power safety management is continuously raised, this OFF state locking means that moving contacts and fixed contacts of a breaker are locked at a breaking and non-closeable OFF state position. The OFF state locking is mainly used for the breakers in a power distribution system, and when the protective branches of a particular breaker in the power distribution system fail or lead to tripping of the breaker or out-of-work of equipment due to fault, the fault reason needs to be checked and the breaker can be closed and used only after all the faults are eliminated, an operation electrician typically carries out a check at the positions of the protective branches or the position of the equipment far away from the protective breaker in the process of manual fault check, in this case, closing operation of the breaker is not allowed so as to prevent the operation electrician from electric shock, and in order to guarantee the safety of the operation electrician, the handle of the circuit-protecting breaker needs to be locked at the OFF position to prohibit breaker closing and thoroughly cut off the transmission path for power supply, only in this way can the safety of the operation electrician be guaranteed during inspection and maintenance. Furthermore, it is also quite common to implement power limitation management by the OFF state locking function, and in particular, it is often necessary to prohibit a power user from closing operation of the breaker without permission within a certain period of time in public places without continuous power use. The ON state locking means that a breaker is locked under an ON state so that manual opening thereof cannot be accomplished, but this does not interfere with fault tripping. The ON state locking is mainly used for some terminal electric appliances that are not in need of tripping protection function or that the handle thereof can still be located at an ON position after tripping, and its purpose is to avoid, for users having a quite low power failure possibility during load side operation, negative influence on working or damage to equipment caused by random power failure.

There are mainly two known principles for an OFF state locking device: 1, built-in locking device: this locking device is located within a breaker, locking/unlocking of the built-in locking device is achieved by a locking button on the breaker or by a remote controller, and its defects include complex structure, occupation on valuable internal space of the breaker, indirect locking state display, poor locking safety and reliability and the like, so this built-in locking device is not commonly used; 2, external locking device: this locking device can be kept under an OFF state in such a manner that a breaker is locked and cannot be closed by limiting the operation of a breaker handle, and its advantages are simple structure, direct locking state display and excellent locking safety and reliability, thus the external locking device is applied extensively. In terms of structure, the OFF state locking device of the existing modularized terminal electric appliances are approximately classified in two structural types: the first one is detachable OFF state locking device that is primarily applicable for nations and regions in which IEC standard is implemented or definite regulations in relation to the structure of the locking device have not been promulgated, this type of device is advantageous in such facts that its structure is small and skillful and that whether the locking device is mounted on a breaker can be determined conveniently by a user with the help of the detachment function, however, its shortcoming is the non-applicability for UL standard-implementing nations and regions, i.e. definite regulations in relation to the structure of the locking device have been promulgated; the second one is non-detachable OFF state locking device, which is primarily applicable for UL standard-implementing nations and regions, i.e. definite regulations in relation to the structure of the locking device have been promulgated, and undoubtedly, which can also be applied in nations and regions in which IEC standard is implemented or definite regulations in relation to the structure of the locking device have not been promulgated. It is assembled together with a breaker and cannot be randomly detached by a user, and the problem of the current non-detachable handle locking device, which exists generally, is inconformity with the requirements of modularized standard, that is: the height of the locking device is larger than the maximal height of the entire electric appliance during motion of the handle of the terminal electric appliance, thus it cannot adapt to a terminal power distribution box under modularized standard, the height of the locking device beside the handle is larger than the maximal external dimension of the breaker after an inspection or maintenance operation comes to an end, namely after the locking function is cancelled, and in case that the breaker is mounted in the box body, the height of the box body, i.e. the height dimension of a transparent enclosure, must be increased because the height of the locking device is higher than the maximal external dimension of the terminal electric appliance and is also non-adjustable so that covering of the transparent enclosure of the modularized terminal power distribution box cannot be accomplished, and this increase could affect the service compatibility of the device in the power distribution box and the consistency in appearance simultaneously. For example, disclosed in U.S. Pat. No. 7,355,132B1 or US2008/0277250A1 are external handle locking devices, which are both provided with a handle for operating the ON/OFF state of the terminal electric appliance and both include a member that is permanently higher than the maximal external dimension of the breaker; after the locking device and the modularized terminal electric appliance are assembled, a relatively large space is occupied by the structure of the operation panel for the locking device or the device is non-adjustable in height, which not only affects the compatibility and adaptability between the handle locking device and the modularized power distribution box, but also causes tremendous inconvenience to normal closing and opening operations of the breaker under an unlocking state, namely, the handle of the breaker cannot be operated conveniently by fingers, and there are some problems that are not in conformity with the requirements of UL standard.

SUMMARY OF THE INVENTION

An objective of the present invention is to overcome the shortcomings in the prior art and provide a handle locking device for a modularized terminal electric appliance. With the help of movable sliders, the heights of the locking device under two states of 'locking' and 'unlocking' can be inconsistent, furthermore, the height under the unlocking state is lower than that under the locking state, so normal operation of the breaker is free from influence of any member under the unlocking state.

Another objective of the present invention is to provide a handle locking device for a modularized terminal electric appliance, which achieves the purpose that the height of the locking device is completely not higher than the maximal external dimension of the modularized terminal electric appliance. It not only has the characteristics of simple and reasonable structure of the external non-detachable locking device, direct locking state exhibition and good locking safety and reliability, but also has the advantages of excellent compatibility with a modularized distribution box, convenient locking and unlocking operations and high degree of humanization.

To achieve the objectives above, adopted in the present invention is the technical scheme below:

Of the first embodiment of the present invention, a handle locking device for a modularized terminal electric appliance comprises a housing base 1 fixedly mounted on one outer side surface 103*a*/103*b* of the housing of the modularized terminal electric appliance 10 through a connection mechanism, a locking mechanism 2 and a padlock 3, the locking mechanism 2 also comprises a sliding member 21 on which a door hole 211 and a padlock hole 219 that are mutually penetrative are arranged, the door hole 211 is internally provided with a horizontal pivoting door 22 and a vertical pivoting door 23 which can both be unfolded or folded, when unfolded, the horizontal pivoting door 22 mates with a handle 102 of the modularized terminal electric appliance 10 to block the reverse motion of the handle 102, the vertical pivoting door 23 and the horizontal pivoting door 22 can mate to block the reverse motion of the unfolded horizontal pivoting door 22, the horizontal pivoting door 22 is pivotally connected to the sliding member 21 through a horizontal pivoting, the axis K1 of the horizontal pivoting is vertical to the height direction Y of the modularized terminal electric appliance 10, the vertical pivoting door 23 is pivotally connected to the sliding member 21 through a vertical pivoting, the axis K2 of the vertical pivoting is parallel with the height direction Y of the modularized terminal electric appliance 10, the padlock 3 is provided with a lock ring 31 which can penetrate through the door hole 211 from the padlock hole 219 and the lock ring can mate with the vertical pivoting door 23 to block the reverse motion of the unfolded vertical pivoting door 23. The locking mechanism 2 is connected and mounted with the housing base 1 through a moving pair mechanism, so that the locking mechanism 2 can only perform up/down sliding along the direction of an assembly reference line B parallel to the height direction Y of the modularized terminal electric appliance 10, and the locking mechanism 2 is defined by a limiting mechanism to slide merely between a corresponding locking working position subsequent to up sliding and a corresponding unlocking hiding position subsequent to down sliding, so that the lock mechanism 2, by way of the shift of the sliding member 21, allows the horizontal pivoting door 22 and the vertical pivoting door 23 to be unfolded or both returned into the door hole 211 and realizes adjustable height position of the locking device under the two states of handle locking and unlocking.

The moving pair mechanism comprises a pair of sliders 212*a*, 212*b* formed on the sliding member 21 and a pair of sliding grooves 12*a*, 12*b* formed on the housing base 1, the sliders 212*a*, 212*b* and the sliding grooves 12*a*, 12*b* creates movable connection in the form of moving pair; or the moving pair mechanism comprises a pair of sliders formed on the house base 1 and a pair of sliding grooves 12*a*, 12*b* formed on the sliding member 21, the sliders and the sliding grooves creates movable connection in the form of moving pair.

The limiting structure comprises a groove hole 13 formed on the housing base 1 and a sliding pin 213 fixedly connected with the sliding member 21, the sliding pin 213 is mounted in the groove hole 13 and is in slide fit with the groove hole 13, the groove hole 13 comprises an upper limiting surface 131 and a lower limiting surface 132, the sliding member 21 is defined at the working position subsequent to up sliding by the contact blocking of the upper limiting surface 131 and the sliding pin 213, and the sliding member 21 is defined at the hiding position subsequent to down sliding by the contact blocking of the lower limiting surface 132 and the sliding pin 213; or the limiting structure comprises a groove hole formed on the sliding member 21 and a sliding pin fixedly connected with the housing base 1, the sliding pin is mounted in the groove hole and is in slide fit with the groove hole, the groove hole comprises an upper limiting surface and a lower limiting surface, the sliding member is defined at the working position subsequent to up sliding by the contact blocking of the lower limiting surface and the sliding pin, and the sliding member is defined at the hiding position subsequent to down sliding by the contact blocking of the upper limiting surface and the sliding pin.

The connection mechanism comprises at leash pair of preformed holes 101*a*, 101*b* formed on the housing of the modularized terminal electric appliance 10, at least a pair of elastic barbs 11*a*, 11*b* formed on the housing base 1, the housing base 1 is fixedly mounted on the outer side surface 103*a*/103*b* of the housing of the modularized terminal electric appliance 10 by clamping fit of the elastic barbs 11*a*, 11*b* and the preformed holes 101*a*, 101*b*. The sliding member 21 is arranged to be symmetrical with the assembly reference line B of the handle locking device, each pair of preformed holes 101*a*, 101*b* on the two outer side surfaces 103*a*, 103*b* of the modularized terminal electric appliance are arranged to be symmetrical with the assembly reference line B, each pair of elastic barbs 11*a*, 11*b* on the housing base 1 are also arranged to be symmetrical with the assembly reference line B, so that the housing base 1 can be interchangeably mounted on the outer side surface 103*a* or the outer side surface 103*b* of the housing of the modularized terminal electric appliance 10.

The handle locking device further comprises a positioning mechanism, the positioning mechanism comprises at least a pair of positioning notches and at least a pair of elastic protrusions, and when the sliding member 21 is at the hiding position or the working position, the same pair of elastic protrusions respectively enters the same pair of positioning notches and comes into elastic contact with the two positioning notches, so that the sliding member 21 is defined at the hiding position or the working position and fails to slide freely; the positioning notches are formed on the sliding member 21 and the elastic protrusions are formed on the housing base 1, or the positioning notches are formed on the housing base 1 and the elastic protrusions are formed on the sliding member 21.

The sliding member 21 comprises a stepped plate-shaped body, which is formed by a first surface 215*a* as well as a second surface 215*b* and a third surface 215*c* parallel with the first surface 215*a*, and further comprises the periphery of the plate-shaped body, which is formed by closed connection of two parallel long side surfaces 216*a*, 216*b* and at least two short side surfaces 217*a*, 217*b*; the first surface 215*a* is arranged towards the outer side surface 103*a*, or 103*b* of the modularized terminal electric appliance 10, the second surface 215*b* is parallel with and lower than an outer surface 12 of the housing base 1, and the third surface 215*c* is arranged towards an inner surface 16 of the housing base 1; the door hole 211 is provided with a rectangular groove which is arranged on the plate-shaped body formed by the first surface 215*a* and the second surface 215*b*, the opening of the groove is connected with the first surface 215*a*, the bottom surface of the groove is connected with the second surface 215*b*, the padlock hole 219 is arranged on the bottom surface of the groove and penetrates through the groove, and a horizontal pivoting hole 210*a* connected with the horizontal pivoting of the horizontal pivoting door 22 and a vertical pivoting hole 210*b* connected with the vertical pivoting of the vertical pivoting door 23 are arranged on the side frame of the door hole 211 respectively; a pinhole 218 is formed on the plate-shaped body formed by the first surface 215*a* and the third surface 215*c*, and the pinhole 218 is fixedly connected with the sliding pin 213 of the limiting mechanism; or, the groove hole is formed on the plate-shaped body formed by the first surface 215*a* and the third surface 215*c*, and the groove hole is in slide fit with the sliding pin of the limiting mechanism; a pair of sliders 212*a*, 212*b* or a pair of sliding grooves are arranged at the upper parts of the two long side surfaces 216*a*, 21*b*, the sliders 212*a*, 212*b* are in slide fit with a pair of sliding grooves 12*a*, 12*b* on the housing base 1; or the sliding grooves are in slide fit with a pair of sliders on the housing base 1; at least a pair of positioning grooves 214*a*, 214*b* or at least a pair of elastic protrusions are arranged on the two long side surfaces 216*a*, 21*b*.

The sum of the thicknesses of the horizontal pivoting door 22 and the vertical pivoting door 23 is less than or equal to the depth of the door hole 211; and the padlock hole 219 is arranged towards the vertical pivoting door 23.

Of another embodiment of the present invention, a lug 220 is arranged on a second side edge 221*b* of the horizontal pivoting door 22, a recess 220*a* is arranged on one side edge of the rectangular groove of the door hole 211 of the sliding member 21, the recess 220*a* is used for receiving the lug 220, and the lug 220 enters the recess 220*a* completely on condition that the horizontal pivoting door 22 is folded and returned into the door hole 211. The sliding member 21 is arranged to be symmetrical with the assembly reference line B of the handle locking device, and the assembly reference line B and the axis O of a rotary shaft 101 of the handle 102 of the modularized terminal electric appliance 10 intersect, so that the OFF and ON positions of the handle 102 are symmetrical with the assembly reference line B.

There are mainly four motion modes for the handle of a modularized terminal electric appliance, i.e. oscillating; linear motion, pressing and rotation, and oscillating and linear motion are relatively common among these motion modes. A oscillating handle means that it can only swing about a certain fulcrum when being pulled, and the linear motion handle means that it can only perform linear motion when being pulled. The handle locking device in the present invention can be applicable for not only the oscillating handle, but also the linear motion handle. The handle locking device in the present invention is adjustable in height after unlocking, and the adjusted height is less than the maximal height of the entire electric appliance under the extreme height in the motion process of the handle of the modularized terminal electric appliance. Such an advantage is formed: the operation plane of the modularized terminal electric appliance under this state is not additionally occupied by any structural part of the locking device, thus the mounting compatibility of the locking device is improved, the problem in the existing locking devices that the cover of a distribution box cannot be closed or the distribution box cannot be mounted in after unlocking is finished, is completed avoided, and the modularized terminal electric appliance with the locking device of the present invention assembled therein can be applicable for any distribution box that is suitable for mounting of this modularized terminal electric appliance; this product is totally in conformity with a variety of requirements in UL standard and can be widely applied to the detection and maintenance procedures for electric circuit and equipment at the rear end of breaker in various IEC standard/UL standard-implementing nations and regions.

BRIEF DESCRIPTION OF THE DRAWINGS

Illustrated in FIG. 1 to FIG. 21 are two embodiments of the handle locking device for modularized breaker in accordance with the invention, wherein FIG. 14 to FIG. 21 are schematic diagrams illustrating the common structures of the first and second embodiments of the handle locking device for modularized terminal electric appliance in accordance with the invention. In the drawings:

FIG. 1 is an assembling stereogram illustrating the assembly of the handle locking device for modularized terminal electric appliance in accordance with the invention and the modularized terminal electric appliance. In the drawing, the handle locking device is under a locking state, the locking mechanism is located at a working position subsequent to up sliding, and the handle of the modularized terminal electric appliance is locked.

FIG. 2 is a structural stereogram illustrating the connection mechanism of the handle locking device for modularized terminal electric appliance in accordance with the invention. Illustrated in the drawing is a structure of the elastic barbs and the preformed holes that can be interchangeably mounted between the two outer side surfaces of the housing of the modularized terminal electric appliance. Symbols 20 and 20' in this drawing represent the same handle locking device, wherein 20 represents that the handle locking device is assembled at the right outer side surface of the modularized terminal electric appliance, and 20' represents that the handle locking device is assembled at the left outer side surface of the modularized terminal electric appliance.

FIG. 3 is a stereogram illustrating the overall structure of the handle locking device for modularized terminal electric appliance in accordance with the invention. In this drawing, the sliding member is located at a working position subsequent to up sliding, and the horizontal pivoting door and the vertical pivoting door are unfolded.

FIG. 4 is a stereogram illustrating the overall structure of the handle locking device as shown in FIG. 3. In this drawing, the sliding member is located at a working position subsequent to up sliding, but the horizontal pivoting door and the vertical pivoting door are folded and do not interfere with down sliding of the sliding member.

FIG. 5 is a stereogram illustrating the sliding member of the locking mechanism in the handle locking device for modularized terminal electric appliance in accordance with the invention, and illustrated in this drawing are a pair of sliders of the moving pair mechanism and the pinhole structure of the limiting structure.

FIG. 6 illustrates the horizontal pivoting door of the locking mechanism in the handle locking device for modularized terminal electric appliance in accordance with the invention.

FIG. 7 is a structural stereogram of the locking mechanism as shown in FIG. 6. Illustrated in this drawing are the position state and connection relationship among the sliding member, the horizontal pivoting door, the vertical pivoting door and the handle of the modularized terminal electric appliance under a locking state, and there is no lug on the horizontal pivoting door in this drawing.

FIG. 8 is a structural stereogram of the second embodiment of the locking device in the handle locking device for modularized terminal electric appliance in accordance with the invention, illustrated in this drawing are the position state and connection relationship among the sliding member, the horizontal pivoting door, the vertical pivoting door and the handle of the modularized terminal electric appliance in case that the locking mechanism can achieve normal locking under an OFF state and that the locking mechanism is under an OFF locking state, and a lug is arranged on the horizontal pivoting door in this drawing.

FIG. 9 is a structural stereogram of the second embodiment of the locking device in the handle locking device for modularized terminal electric appliance in accordance with the invention, illustrated in this drawing are the position state and connection relationship among the sliding member, the horizontal pivoting door, the vertical pivoting door and the handle of the modularized terminal electric appliance in case that the locking mechanism cannot achieve locking under an ON state (i.e. ON state locking is forbidden), the lug on the horizontal pivoting door is stopped by the handle of the modularized terminal electric appliance under an ON state, or ON state locking is forbidden.

FIG. 10 is a stereogram illustrating the overall structure of the second embodiment of the handle locking device for modularized terminal electric appliance in accordance with the invention, and in this drawing, the sliding member is located at a working position subsequent to up sliding, and the horizontal pivoting door and the vertical pivoting door are unfolded.

FIG. 11 is a stereogram illustrating the overall structure of the second embodiment of the handle locking device as shown in FIG. 10 under different states. In this drawing, the sliding member is located at a working position subsequent to up sliding, but the horizontal pivoting door and the vertical pivoting door are folded, the lug on the horizontal pivoting door enter the notch on the sliding member, and the horizontal pivoting door and the vertical pivoting door do not interfere with down sliding of the sliding member.

FIG. 12 is a stereogram illustrating the sliding member of the locking mechanism in the second embodiment of the handle locking device for modularized terminal electric appliance in accordance with the invention. Illustrated in this drawing are a pair of sliders of the moving pair mechanism, the pinhole of the limiting structure, the door hole, the notch and the like.

FIG. 13 illustrates the horizontal pivoting door of the locking device in the second embodiment of the handle locking device for modularized terminal electric appliance in accordance with the invention, and a lug is arranged on the horizontal pivoting door.

FIG. 14 is a rear view of FIG. 5 or FIG. 12, i.e. a rear stereogram illustrating the sliding member of the locking mechanism in the first and second embodiments.

FIG. 15 is a stereogram illustrating the housing base in the first and second embodiments of the handle locking device for modularized terminal electric appliance in accordance with the invention. Illustrated in this drawing are a pair of sliding grooves of the moving pair mechanism, the groove holes of the limiting structure and the like.

FIG. 16 is a partial stereogram illustrating the housing base in the first and second embodiments of the handle locking device for modularized terminal electric appliance in accordance with the invention. Illustrated in this drawing are the elastic protrusions of the positioning mechanism and the like.

FIG. 17 is a structural stereogram illustrating the positioning mechanism in the first and second embodiments of the handle locking device for modularized terminal electric appliance in accordance with the invention. Illustrated in the drawing is the mating relationship between the elastic protrusions and the notches.

FIG. 18 is a rear view of FIG. 3, FIG. 4, FIG. 10 and FIG. 11, i.e. a rear stereogram of the first and second embodiments of the handle locking device for modularized terminal electric appliance, and the sliding member in this drawing is located at a working position subsequent to up sliding.

FIG. 19 is a top stereogram of the first and second embodiments of the handle locking device for modularized terminal electric appliance in accordance with the invention. Illustrated in this drawing is the appearance structure of the limiting mechanism, and the sliding member is located at a working position subsequent to up sliding.

FIG. 20 is a mounting stereogram of the first and second embodiments of the handle locking device for modularize therminal electric appliance in accordance with the invention. Illustrated in this drawing is the exploded state of the handle locking device and the modularized terminal electric appliance before assembly.

FIG. 21 is a mounting stereogram under a state different from FIG. 20, and illustrated in this drawing is the combination state of the handle locking device and the modularized terminal electric appliance after assembly.

DETAILED DESCRIPTION OF THE EMBODIMENTS

Figure 1:
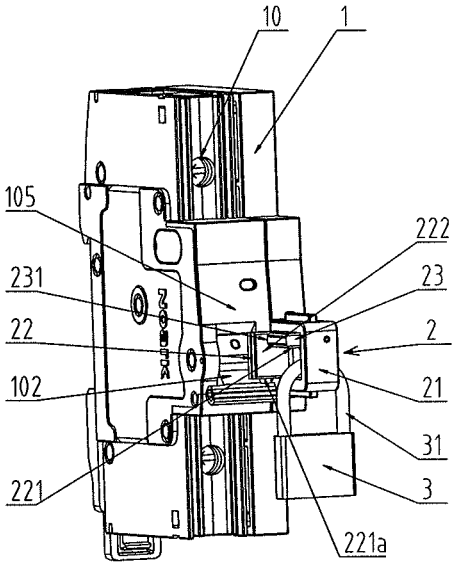
FIG. 1 to FIG. 7 illustrate the first embodiment of the handle locking device for modularized breaker in accordance with the invention.
Figure 2:
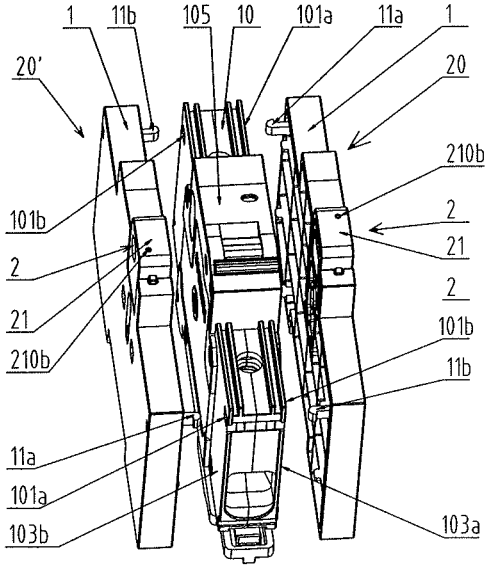
Figure 21:
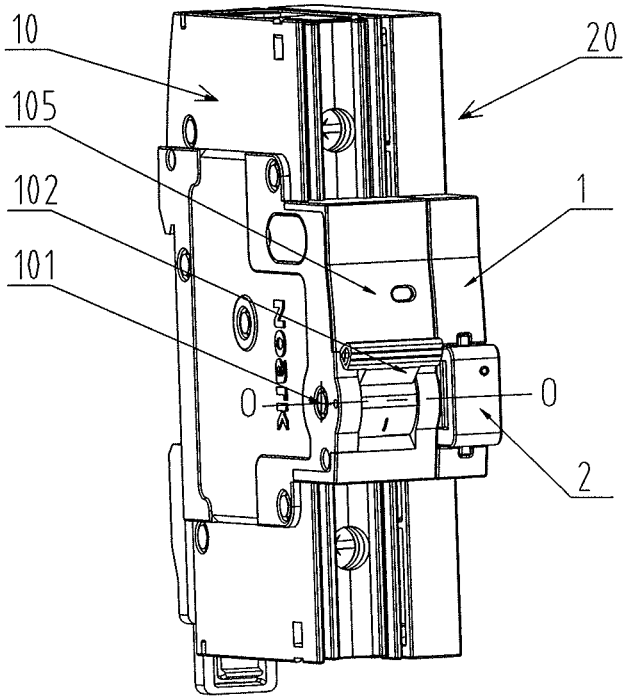

Detailed description is made below to the structure and motion principle of the handle locking device for modularized terminal electric appliance in accordance with the invention as well as the superiorities thereof with reference to the first and second embodiments as shown in FIG. 1 to FIG. 21 that take a modularized low-voltage breaker as example. The locking device in the first embodiment as shown in FIG. 1 to FIG. 7 can realize not only OFF state locking, but also ON state locking, while the locking device in the second embodiment as shown in FIG. 8 to FIG. 13 can realize OFF state locking only. Before detailed description is made below to the first and second embodiments, the common structures in the first and second embodiments shall be described at first, that is, the parts that form these structures are all universal. The handle locking device for the breaker 10 in accordance with the invention is mainly composed of three parts, including a housing base 1, a locking mechanism 2 and a padlock 3 (FIG. 1), and locking function members in the invention are realized in a mode of sliders, so that displacement of the locking function members under the locking and unlocking states is changeable, in order to automatically adjust the different heights of the locking device under the two aforementioned states. FIG. 21 is an example in which the sliding member of the locking mechanism 2 slides in when the breaker works normally, and FIG. 1 is an example in which the sliding member (not shown) slides out when the handle of the breaker is locked. With reference to FIG. 2, the housing base 1 of the locking device can be fixedly mounted on the outer side surface 103*a* at the left side of the housing of the breaker 10 or on the outer side surface 103*b* at the right side of the housing of the breaker 10 through a connection mechanism, while the existing locking device can be assembled on a certain outer side surface of the housing of the breaker 10 only. At least a pair of preformed holes 101*a*, 101*b* is arranged at the two sides of the housing of the breaker 10, the preformed hole 101*a* or the preformed hole 101*b* penetrates through the through holes on the inner and outer side surfaces of the housing of the breaker 10; correspondingly, at least a pair of elastic barbs 11*a*, 11*b* is formed on the housing base 1 of the locking device through elastic arms 111*a*, 111*b*, that is to say, the elastic barb 11*a* or the elastic barb 11*b* comprises one elastic arm 111*a*, 111*b*. The connection mechanism is composed of the preformed holes 101*a*, 101*b* and the elastic barbs 11*a*, 11*b*, and the housing base 1 is fixedly mounted on the side surface 103*a* or 103*b* of the breaker 10 by clamping fit of the elastic barbs (11*a*, 11*b*) and the preformed holes (101*a*, 101*b*). The clamping fit described herein means that: when the elastic barbs 11*a*, 11*b* are inserted into the preformed holes 101*a*, 101*b* respectively, the operation force for this insertion operation overcomes a reaction force of the preformed holes 101*a*, 101*b* for the elastic barbs 11*a*, 11*b* so as to result in elastic deform of the elastic arms 111*a*, 111*b*; after the elastic barbs 11*a*, 11*b* penetrate through the preformed holes 101*a*, 101*b* respectively, the elastic barbs 11*a*, 11*b* are driven by the elastic arms 111*a*, 111*b* to accomplish resetting because the elastic barbs 11*a*, 11*b* lose the elastic reaction force of the preformed holes 101*a*, 101*b*, and under this resetting state, the inner side surface of the housing of the breaker 10 is hooked by the elastic barbs 11*a*, 11*b* so that the elastic barbs 11*a*, 11*b* are fixed inside the preformed holes 101*a*, 101*b* and the housing base 1 is fixedly mounted on the outer side surface 103*a* or 103*b* of the breaker 10. Undoubtedly, an alternative that the housing base 1 is fixedly mounted on the outer side surface 103*a* or 103*b* of the breaker 10 can also be implemented.

Figure 3:
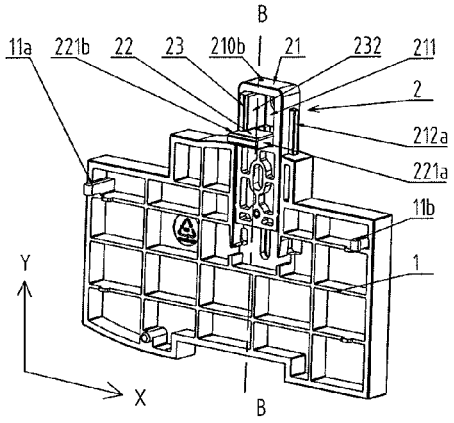
Figure 4:
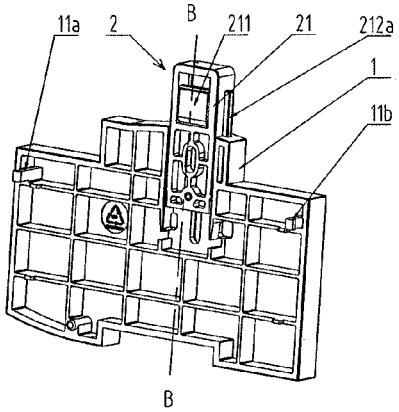
Figure 5:
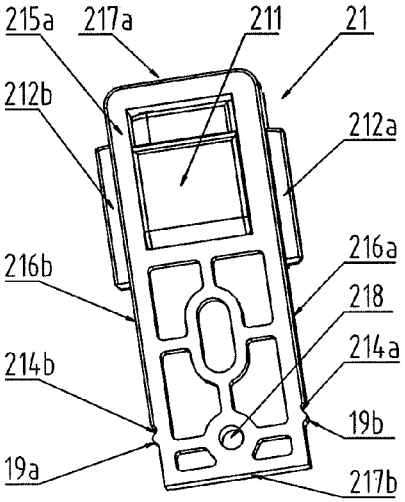
Figure 6:
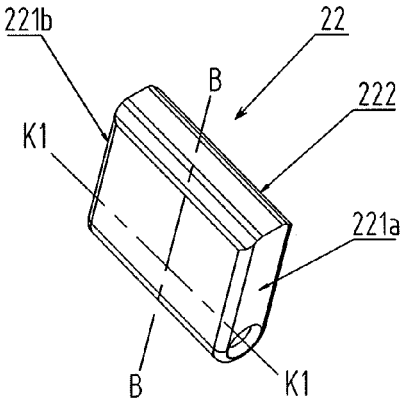
Figure 7:
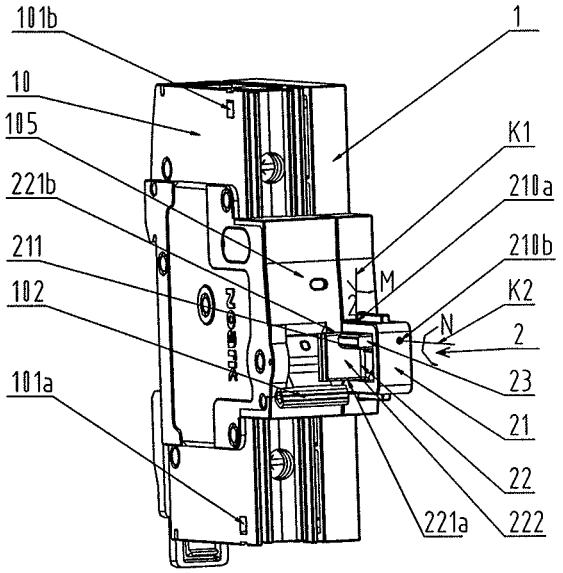
Figure 8:
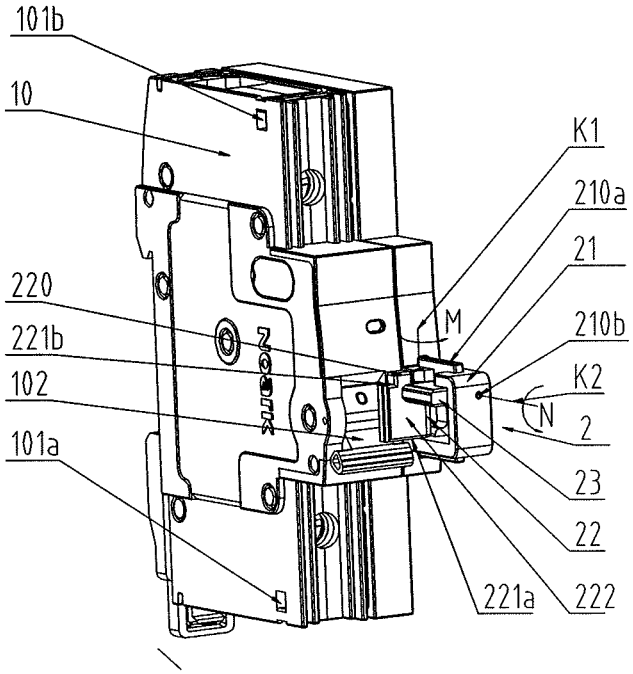
FIG. 8 to FIG. 13 illustrate the second embodiment of the handle locking device for modularized terminal electric appliance.
Figure 9:
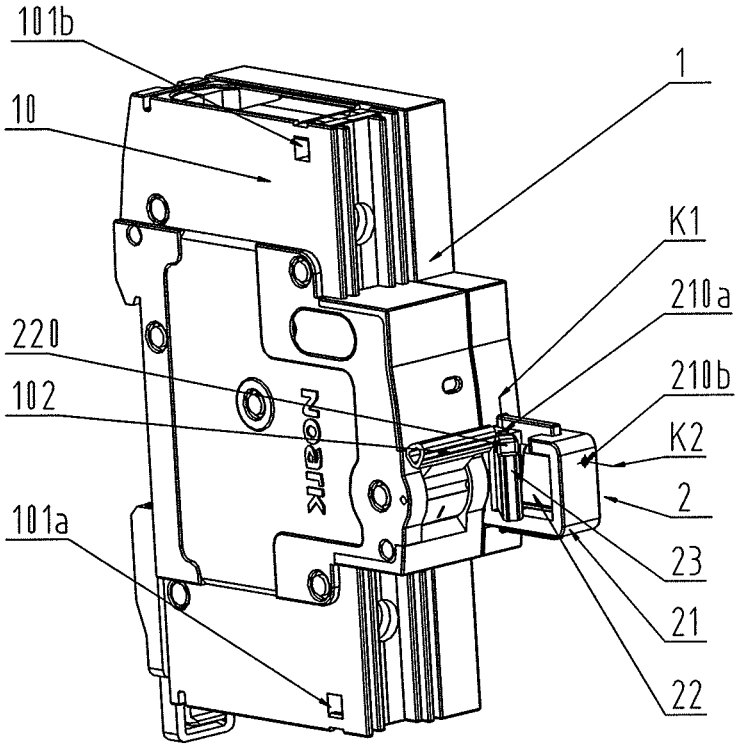
Figure 10:
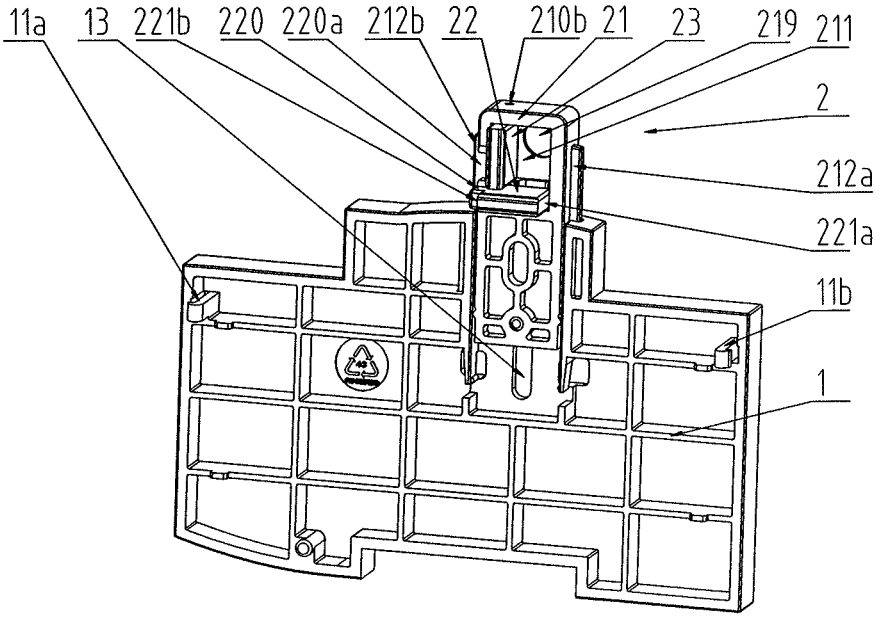
Figure 11:
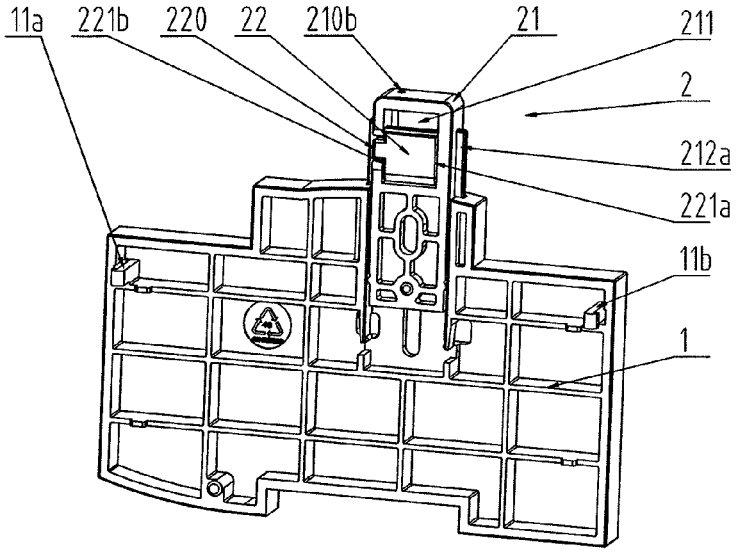

Description is made below to the locking mechanism 2 of the locking device and its working principle with reference to the drawings. As shown in FIG. 5 and FIG. 7, the locking mechanism 2 comprises a sliding member 21 with a door hole 211 arranged thereon, a horizontal pivoting door 22 and a vertical pivoting door that can be unfolded in the direction of the breaker 10 are arranged inside the door hole 211, the horizontal pivoting door 22 is pivotally connected to the sliding member 21 through a horizontal pivoting (not shown in the drawings), the axis K1 of the horizontal pivoting is vertical to the height direction Y of the breaker 10, the vertical pivoting door 23 is pivotally connected to the sliding member 21 through a vertical pivoting (not shown in the drawings), the axis K2 of the vertical pivoting is parallel with the height direction Y of the breaker 10. The locking mechanism 2 is connected and mounted with the housing base 1 through a moving pair mechanism, so that the locking mechanism 2 can only perform up/down sliding along the height direction Y of the breaker 10, and the locking mechanism 2 is defined by a limiting mechanism to slide between a working position subsequent to up sliding and a hiding position subsequent to down sliding. That is to say, the locking mechanism 2 is defined by the moving pair mechanism to have only one degree of freedom for up or down linear sliding on the housing base 1, and the range of the locking mechanism 2 for up or down linear sliding on the housing base 1 is defined by the limiting mechanism. When the locking mechanism 2 slides up to reach an upper limit position thereof (the position as shown in FIG. 1, FIG. 3, FIG. 4, FIG. 7, FIG. 8, FIG. 10, FIG. 11 and FIG. 18), a locking operation can be performed, therefore, this position is defined as the working position; when the locking mechanism 2 slides down to reach a lower limit position (the position as shown in FIG. 2 and FIG. 21), the locking mechanism 2 is under a non-working state and is hidden, so that any part of the handle locking device, including the locking mechanism 2, does not exceed the external dimension of the breaker 10 in the height direction Y and the width direction X, therefore, this position is defined as the hiding position. Just because of the function that the locking mechanism 2 can slide down to reach the hiding position under an unlocking state, an operation panel 105 of the breaker 10 is not additionally occupied by any structural part of the locking device, that is to say, assembly of the locking device and the breaker 10 is applicable for any distribution box that is suitable for mounting of a modularized terminal electric appliance. The external dimension of the breaker 10 in the height direction Y and the width direction X is unified and standardized, so it is definite, that is to say, the external dimension of the handle locking device of the invention in the height direction Y and the width direction X after unlocking is equal to or less than the dimension according to unified regulations in modularized standard. The handle locking device is assembled on the side surface thereof and the locking mechanism 2 can slide up and down (i.e. height-adjustable) and can be hidden after unlocking, so after the handle locking device of the invention is mounted on the breaker 10, no correlation is guaranteed between any part of the handle locking device and the panel 105 of the breaker 10 under the unlocking state, and neither normal operation functions of the breaker 10 nor clear display of the ON/OFF state of the breaker 10 is affected. Furthermore, use of the aforementioned connection mechanism and the locking mechanism endows the handle locking device of the invention with reliable and effective mechanical strength and properties, and can ensure non-operability of the modularized terminal electric appliance under the locking state. Specifically, in the case that the locking mechanism 2 is located at the working position subsequent to up sliding: unfolding of the horizontal pivoting door 22 is allowed in the locking mechanism 2, that is to say, the horizontal pivoting door 22 is overturned about the axis K1 of the horizontal pivoting in the direction of the breaker 10 (the direction opposite to a rotation direction M), as shown in FIG. 7 and FIG. 8, so that the horizontal pivoting door 22 and the handle 102 of the breaker 10 mate (that is to say, a first side of the horizontal pivoting door 22 is in contact fit with the handle door 102 along 221*a*) to block the reverse rotation of the handle 102, afterwards, the vertical pivoting door 23 is unfolded, that is to say, the vertical pivoting door 23 is overturned about the axis K2 of the vertical pivoting in the direction of the breaker 10 (the direction opposite to a rotation direction N), as shown in FIG. 7 and FIG. 8, so that the vertical pivoting door 23 and the horizontal pivoting door 22 mate (that is to say, the lower edge of the vertical pivoting door 23 is in contact fit with an upper surface 222 of the horizontal pivoting door 22) to block the reverse rotation of the horizontal pivoting door 22, and finally, the padlock 3 is locked from the door hole 211 and is enabled to mate with the vertical pivoting door 23 (that is to say, a lock ring 31 of the padlock 3 is in contact fit with the interior of the vertical pivoting door 23) to block the reverse rotation of the vertical pivoting door 23 (as shown in FIG. 1, FIG. 3, FIG. 7, FIG. 8 and FIG. 10), in this way, the handle 102 is locked and accordingly cannot swing. In the embodiment as shown in the drawings, the handle of the breaker is a oscillating handle, and it can be seen from the structure of the aforementioned locking mechanism 2 that, mating of the horizontal pivoting door 22 and the handle 102 of the breaker 10 is not limited by the motion form of the handle 102, so a first side edge 221*a* of the horizontal pivoting door 22 can be in complete contact fit with a linear motion handle and the linear motion handle cannot move backwards, as a result, the handle locking device for modularized terminal electric appliance in accordance with the invention is applicable for not only a oscillating handle, but also a linear motion handle. In the case that the locking mechanism 2 is under the locking working state subsequent to up sliding as shown in FIG. 1, FIG. 7 and FIG. 8, dismantlement of the padlock 3 at first and then folding of the vertical pivoting door 23 is also allowed in the locking mechanism 2, that is to say, the vertical pivoting door 23 is rotated backwards about the axis K2 of the vertical pivoting in the direction of the door hole 211 (the direction of the rotation direction N), as shown in FIG. 7 and FIG. 8, and then, the horizontal pivoting door 22 is folded, that is to say, the horizontal pivoting door 22 is rotated backwards about the axis K1 of the horizontal pivoting in the direction of the door hole 211 (the direction of the rotation direction M), as shown in FIG. 7 and FIG. 8, and finally, both the horizontal pivoting door 22 and the vertical pivoting door 23 are returned into the door hole 211 (as shown in FIG. 4 and FIG. 11). In the case that the locking mechanism 2 is located at the position subsequent to up sliding, but under a non-locking state, as shown in FIG. 4 and FIG. 11, a down sliding operation is allowed, the locking mechanism 2 is pressed downwards by a human hand until it reaches the hiding position as shown in FIG. 21. In the case that the locking mechanism 2 is located at the hiding position subsequent to down sliding, as shown in FIG. 21, both the horizontal pivoting door 22 and the vertical pivoting door 23 are returned into the door hole 211 in order not to interfere with up/down sliding of the locking mechanism 2, and the height of the locking mechanism 2 is less than that of the breaker 10. In the case that the locking mechanism 2 is located at the hiding position subsequent to down sliding, an up sliding operation is allowed, the locking mechanism 2 is pulled up by a human hand until it reaches the up-sliding position as shown in FIG. 4 and FIG. 11. In the case that the locking mechanism 2 is located at the up-sliding position, as shown in FIG. 4 and FIG. 11, an unfolding operation of the horizontal pivoting door 22 and the vertical pivoting door 23 is allowed, and this operation is not stopped until the state as shown in FIG. 3, FIG. 7, FIG. 8 and FIG. 10 is achieved. Under the state as shown in FIG. 3, FIG. 7, FIG. 8 and FIG. 10, an unlocking operation is allowed, and this operation is not stopped until the state as shown in FIG. 1 is achieved.

The moving pair mechanism of the locking mechanism 2 comprises a pair of sliders 212*a*, 212*b* (FIG. 3-FIG. 5) formed on the sliding member 21 and a pair of sliding grooves 12*a*, 12*b* (FIG. 15) formed on the housing base 1, movable connection in the form of moving pair is generated between the sliders 212*a*, 212*b* and the sliding grooves 12*a*, 12*b*, so that the locking mechanism 2 is connected and mounted on the housing base 1. The form of moving pair indicates that the sliders 212*a*, 212*b* are inserted into the sliding grooves 12*a*, 12*b* respectively, and movable connection between the sliders 212*a*, 212*b* and the sliding grooves 12*a*, 12*b* is realized by means of slide fit between the sliders 212*a*, 212*b* and the sliding grooves 12*a*, 12*b*, that is to say, movable connection between the sliding member 21 of the locking mechanism 2 and the housing base 1 is generated, so that the locking mechanism 2 is connected and mounted on the housing base 1, and its characteristic is that there is only one degree of freedom for linear sliding between the sliding member 21 and the housing base 1. The structure of the moving pair mechanism as shown in the drawings is a preferred scheme, and an alternative structure of the moving pair mechanism is as follows: the moving pair mechanism comprises a pair of sliders (not shown in the drawings) formed on the housing base 1 and a pair of sliding grooves (not shown in the drawings) formed on the sliding member 21, and movable connection in the form of moving pair is generated between the sliders and the sliding grooves, so that the locking mechanism 2 is connected and mounted on the housing base 1.

With reference to FIG. 15, FIG. 17 and FIG. 19, the limiting mechanism of the locking mechanism 2 comprises a groove hole 13 formed on the housing base 1 and a sliding pin 213 fixedly connected with the sliding member 21, the sliding pin 213 is mounted in the groove hole 13 and is in slide fit with the groove hole 13 (as shown in FIG. 19), the groove hole 13 comprises an upper limiting surface 131 and a lower limiting surface 132, the sliding member 21 is defined at the working position subsequent to up sliding by the contact blocking of the upper limiting surface 131 and the sliding pin 213, and the sliding member 21 is defined at the hiding position subsequent to down sliding by the contact blocking of the lower limiting surface 132 and the sliding pin 213. A scheme that is alternative to the structure scheme of the limiting mechanism as shown in the drawings is as follows: the limiting structure comprises a groove hole (not shown in the drawings) formed on the sliding member 21 and a sliding pin (not shown in the drawings) fixedly connected with the housing base 1, the sliding pin is mounted in the groove hole and is in slide fit with the groove hole, and the groove hole comprises an upper limiting surface and a lower limiting surface. Threaded connection, pin connection, adhesive connection or integral formation may be employed for the structure of fixed connection between the sliding pin 213 and the sliding member 21 (or between the sliding pin and the housing base 1). In the case that the groove hole is formed on the sliding member 21, the upper limiting surface of the groove hole still means the limiting surface on the upper surface (i.e. near the door hole 211) and the lower limiting surface of the groove hole still means the limiting surface on the lower surface (i.e. far away from the door hole 211).

The handle locking mechanism for modularized terminal electric appliance in the invention further comprises a positioning mechanism for preventing the sliding member 21 from free sliding at particular positions, and it specifically means that, the sliding member 21 is prevented from free sliding at the hiding position and/or working position, including: it is prevented from free sliding at the hiding position only; or it is prevented from free sliding at the up-sliding position only; or it is prevented from free sliding not only at the hiding position, but also at the up-sliding position. In terms of the working principle of the handle locking device, it can still work normally if there is no positioning mechanism, however, use of the positioning mechanism can bringing more perfect functions of the handle locking device, e.g. the performance of preventing the sliding member from free sliding at the hiding position can prevent the handle locking device from free sliding at a variety of mounting positions; and the performance of preventing the sliding member from free sliding at the up-sliding position can bring a more convenient locking operation of the handle locking device. Needed in the positioning mechanism is only the function of preventing the sliding member 21 from free sliding at particular positions, the positioning mechanism cannot limit the sliding of the sliding member 21 under up/down operations, or in other words, up/down operations of the locking mechanism 2 by a human hand can automatically eliminate the sliding limitation of the positioning mechanism on the sliding member 21. In the implementation modes as shown in FIG. 5, FIG. 12, FIG. 16 and FIG. 17, the positioning mechanism comprises at least a pair of positioning notches 214*a*, 214*b* formed on the sliding member 21 and at least a pair of elastic protrusions 14*a*, 14*b* formed on the housing base 1, the sliding member 21 interacts with convex points 19*a*, 19*b* at first in the push-in process, and while the sliders are continuously pushed, the elastic protrusions 14*a*, 14*b* slide into the circular arc positioning notches 214*a*, 214*b*. When the sliding member 21 is at the hiding position, the two elastic protrusions 14*a*, 14*b* respectively enter the two positioning notches 214*a*, 214*b* and come into elastic contact with the two positioning notches 214*a*, 214*b*, so that the sliding member 21 is prevented from free sliding at the hiding position under an elastic action force, the contact fit between the elastic protrusions 14*a*, 14*b* and the positioning notches 214*a*, 214*b* is shown in FIG. 17, and its characteristic is that the positioning notches 214*a*, 214*b* are formed on the sliding member 21 and move along with the sliding member 21, while the elastic protrusions 14*a*, 14*b* are formed on the housing base 1. An elastic protrusion movement scheme that is alternative to the notch movement scheme as shown in the drawings has such a structure that: the positioning mechanism comprises at least a pair of positioning notches (not shown in the drawings) formed on the housing base 1 and at least a pair of elastic protrusions (not shown in the drawings) formed on the sliding member 21, when the sliding member 21 is at the hiding position, the two elastic protrusions respectively enter the two positioning notches and come into elastic contact with the two positioning notches, so that the sliding member 21 is prevented from free sliding at the hiding position. The positioning mechanism as shown in the drawings only prevents the sliding member 21 from free sliding at the hiding position, and it is not difficult to realize that, if the sliding member 21 needs to be prevented from free sliding at both the hiding position and the working position, these two notch movement schemes below can be used for replacing the implementation scheme as shown in the drawings: the first scheme is as follows, the positioning mechanism comprises at least a pair of positioning notches 214*a*, 214*b* formed on the sliding member 21 and at least a pair of elastic protrusions 14*a*, 14*b* formed on the housing base 1, the first pair of positioning notches 214*a*, 214*b* comes into contact with the two elastic protrusions 14*a*, 14*b* respectively when the sliding member 21 is at the hiding position, so that the sliding member 21 is prevented from free sliding at the hiding position, and the second pair of positioning notches (not shown in the drawings) comes into contact with the two elastic protrusions 14*a*, 14*b* respectively when the sliding member 21 is at the working position, so that the sliding member 21 is prevented from free sliding at the working position. The second scheme is as follows: the positioning mechanism comprises two pairs of positioning notches 214*a*, 214*b* formed on the sliding member 21 and two pairs of elastic protrusions 14*a*, 14*b* formed on the housing base 1, the first pair of elastic protrusions 14*a*, 14*b* respectively enters the first pair of positioning notches 214*a*, 214*b* and comes into elastic contact with the two positioning notches 214*a*, 214*b* when the sliding member 21 is at the hiding position, so that the sliding member 21 is prevented from free sliding at the hiding position, and the second pair of elastic protrusions (not shown in the drawings) respectively enters the second pair of positioning notches (not shown in the drawings) and comes into elastic contact with the two positioning notches 214*a*, 214*b* when the sliding member 21 is at the working position, so that the sliding member 21 is prevented from free sliding at the working position. The three aforementioned notch movement schemes can be concluded as follows: the positioning mechanism comprises at least a pair of positioning notches 214*a*, 214*b* formed on the sliding member 21 and at least a pair of elastic protrusions 14*a*, 14*b* formed on the housing base 1, and when the sliding member 21 is at the hiding position or the working position, the same pair of elastic protrusions 14*a*, 14*b* respectively enters the same pair of positioning notches 214*a*, 214*b* and comes into elastic contact with the two positioning notches 214*a*, 214*b*, so that the sliding member 21 is prevented from free sliding at the hiding position or the working position. Similarly, with reference to the three aforementioned notch movement schemes, it is not difficult to conclude three elastic protrusions movement schemes that are alternative to these three notch movement schemes: the positioning mechanism comprises at least a pair of positioning notches (not shown in the drawings) formed on the sliding member 21 and at least a pair of elastic protrusions (not shown in the drawings) formed on the housing base 1, and when the sliding member 21 is at the hiding position or the working position, the same pair of elastic protrusions respectively enters the same pair of positioning notches and comes into elastic contact with the two positioning notches, so that the sliding member 21 is prevented from free sliding at the hiding position or the working position. The elastic protrusion movement schemes have such a characteristic that the elastic protrusions are formed on the sliding member 21 and move along with the sliding member 21, while the positioning notches are formed on the housing base 1.

Figure 12:
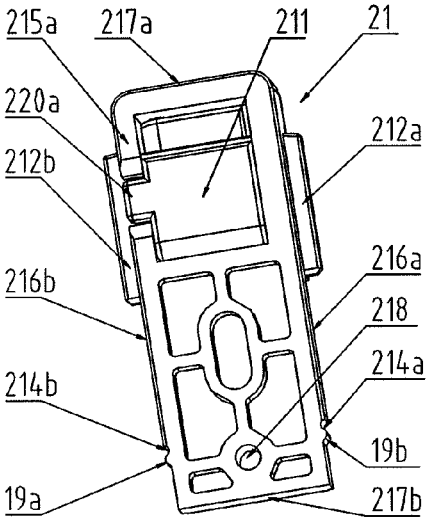
Figure 13:
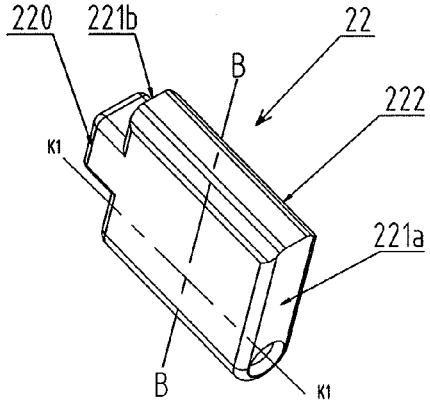
Figure 20:
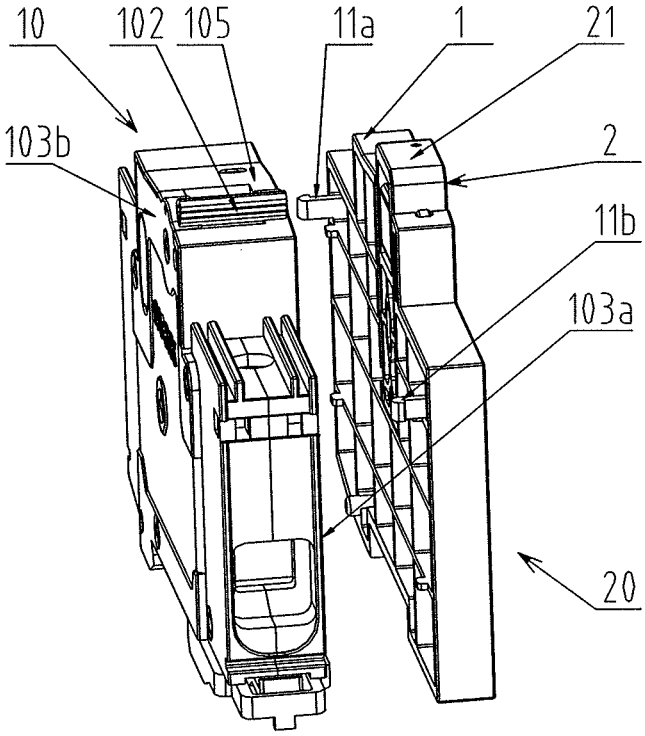

With reference to FIG. 5, FIG. 12 and FIG. 14, the sliding member 21 of the locking mechanism 2 comprises a first surface 215*a*, a second surface 215*b* parallel with the first surface 215*a*, a third surface 215*c* parallel with the first surface 215*a*, two parallel long side surfaces 216*a*, 216*b* and at least two short side surfaces 217*a*, 217*b*, the first surface 215*a*, the second surface 215*b* and the third surface 215*c* form the stepped plate-shaped body structure of the sliding member 21, the periphery of the plate-shaped body is formed by closed connection of the long side surfaces 216*a*, 216*b* and the short side surfaces 217*a*, 217*b*, that is to say, the stepped plate-shaped body structure composed of a plurality of surfaces, as shown in FIG. 5, FIG. 12 and FIG. 14, is formed. The first surface 215*a* faces towards the outer side surface 103*a* or 103*b* of the breaker 10, a gap is formed between the first surface 215*a* and the side surface 103*a* or 103*b* of the breaker 10 after the handle locking device is mounted on the breaker 10, so that sliding of the sliding member 21 is not affected by the side surface 103*a* or 103*b*. The second surface 215*b* is parallel with and lower than an outer surface 12 of the housing base 1, that is to say, the second surface 215*b* is of a recessed structure on the outer surface 12 in order to guarantee that sliding of the sliding member 21 is not affected by extrusion of other adjacent terminal electric appliances on a mounting rail after the handle locking device is mounted on the mounting rail (not shown in the drawings). The third surface 215*c* faces towards an inner surface 16 of the housing base 1 and a gap is formed between the third surface 215*c* and the inner surface 16. The door hole 211 in a rectangular groove structure, as shown in FIG. 5 and FIG. 12, is arranged on the plate-shaped body formed by the first surface 215*a* and the second surface 215*b*, the opening of the groove is connected with the first surface 215*a*, a padlock hole 219 (as shown in FIG. 14) that is penetrative to the groove is arranged on the bottom surface of the groove, and a horizontal pivoting hole 210*a* connected with the horizontal pivoting of the horizontal pivoting door 22 and a vertical pivoting hole 210*b* connected with the vertical pivoting of the vertical pivoting door 23 (as shown in FIG. 7 and FIG. 8) are arranged on the side frame of the door hole 211 respectively. A pinhole 218 is arranged on the plate-shaped body formed by the first surface 215*a* and the third surface 215*c*, and is fixedly connected with a sliding pin 213 of the limiting mechanism; or, a groove hole is arranged on the plate-shaped body formed by the first surface 215*a* and the third surface 215*c*, and is in slide fit with the sliding pin (not shown in the drawings, and only applicable for the aforementioned structure scheme that is alternative to the limiting mechanism in the embodiments as shown in the drawings) of the limiting mechanism. A pair of sliders 212*a*, 212*b* that is in slide fit with a pair of 12*a*, 12*b* on the housing base 1 is arranged on the upper parts of the two long side surfaces 216*a*, 216*b*, or, a pair of sliding grooves is arranged on the upper parts of the two long side surfaces 216*a*, 216*b*, and is in slide fit with a pair of sliders (not shown in the drawings, and only applicable for the aforementioned structure scheme that is alternative to the moving pair mechanism as shown in the drawings) on the housing base 1. A pair of positioning grooves (214*a*, 214*b*) is arranged on the two long side surfaces 216*a*, 216*b* as shown in FIG. 5, FIG. 12 and FIG. 14; or, two pairs of positioning grooves are arranged on the two long side surfaces 216*a*, 216*b* (not shown in the drawings, and only applicable for the aforementioned notch movement scheme that is alternative to the positioning mechanism as shown in the drawings); or, at least a pair of elastic protrusions are arranged on the two long side surfaces 216*a*, 216*b* (not shown in the drawings, and only applicable for the aforementioned elastic protrusion movement scheme that is alternative to the positioning mechanism as shown in the drawings).

The sum of the thicknesses of the horizontal pivoting door 22 and the vertical pivoting door 23 is less than or equal to the depth of the door hole 211 and the depth of the door hole is also the depth of the rectangular groove on the sliding member 21, so that the horizontal pivoting door 22 and the vertical pivoting door 23 are completely returned into the door hole under a folded state (as shown in FIG. 4 and FIG. 11), which ensures that normal sliding of the sliding member 21 is not affected by the horizontal pivoting door 22 and the vertical pivoting door 23. The padlock hole 219 is opposite to the vertical pivoting door 23, that is to say, the vertical pivoting door 23, when being returned into the door hole 211, shelters (completely or partially shelters) the padlock hole 219, so that action of the padlock is accompanied by unfolding of the horizontal pivoting door 22 and the vertical pivoting door 23. The specific procedure is as follows: after the tip of the lock ring 31 of the padlock 3 is stretched into the door hole 211 from the padlock hole 219, the opposite vertical pivoting door 23 is naturally pushed to rotate in the direction of the breaker 10, this rotation of the vertical pivoting door 23 pushes the horizontal pivoting door 22 to rotate in the direction of the breaker 10, and the tip of the lock ring 31 can be stretched out of the door hole and then buckled with the padlock 3 for the purpose of locking after the horizontal pivoting door 22 and the vertical pivoting door 23 are completely unfolded. Due to use of the horizontal pivoting door 22, the vertical pivoting door 23 and the optimized integrative structure of the padlock hole 219 and the sliding member 21 above, the locking mechanism 2 of the invention is not only convenient for operation and reliable in locking, but also has the advantage of minimized structural space.

With reference to FIG. 1 to FIG. 21, description is respectively made below to different implementation modes in the first and second embodiments of the handle locking device for modularized terminal electric appliance in accordance with the invention.

With reference to the first embodiment of the handle locking device for modularized terminal electric appliance in accordance with the invention as shown in FIG. 1 to FIG. 7 and FIG. 14 to FIG. 21, three different mounting modes of the handle locking device can be realized selectively by switching the position structure of the preformed holes 101*a*, 101*b* and the elastic barbs 11*a*, 11*b* of the connection mechanism: 1, fixed mounting of the housing base 1 on the outer side surface 103*a* at the left side of the housing of the breaker 10 is allowed only; 2, fixed mounting of the housing base 1 on the outer side surface 103*b* at the right side of the housing of the breaker 10 is allowed only; and 3, the housing base 1 can be interchangeably fixedly mounted on the outer side surface 103*a* at the left side of the housing of the breaker 10 or the outer side surface 103*b* at the right side of the housing of the breaker 10. In case of the first and second mounting modes, the position structure between the elastic barbs 11*a*, 11*b* and the preformed holes 101*a*, 101*b* of the connection mechanism shall satisfy two fundamental conditions: 1, the demand on clamping fit between the elastic barbs 11*a*, 11*b* and the preformed holes 101*a*, 101*b* is met; and 2, the demand on locking fit between the locking mechanism 2 mounted on the single outer side surface 103*a* or 103*b* of the breaker 10 and the handle 102 of the breaker 10 is met. The mounting mode as shown in FIG. 3, FIG. 4 and FIG. 7 is a right-side mounting mode, that is to say, the first side edge 221*a* of the horizontal pivoting door 22 is in contact fit with the handle 102, and it is not difficult to realize that, the horizontal pivoting door 22 is symmetrical with the assembly reference line B, i.e. the first side edge 221*a* and the second side edge 221*b* are arranged in a manner of being symmetrical with the assembly reference line B, so under a left-side mounting mode that the handle locking device is fixedly mounted on the side surface 103*b* at the left side of the breaker 10, the second side edge 221*b* of the horizontal pivoting door 22 is in contact fit (not shown in the drawings) with the handle 102. In case of the third mounting mode, however, the position structure between the elastic barbs 11*a*, 11*b* and the preformed holes 101*a*, 101*b* of the connection mechanism shall satisfy not only the two aforementioned fundamental conditions, but also a third condition, i.e. mounting of the locking mechanism 2 on the two outer side surfaces 103*a*, 103*b* needs to meet the demand on locking fit between the locking mechanism 2 and the handle 102 of the breaker 10. Therefore, when the third mounting mode is selected, the position structure scheme below also needs to be adopted for the structure between the elastic barbs 11*a*, 11*b* and the preformed holes 101*a*, 101*b* of the connection mechanism on the basis of the aforementioned structure scheme, the handle locking devices of the breaker 10 as shown in FIG. 2, having mark numbers 20 and 20', represent the handle locking devices of the same modularized terminal electric appliance, but based only upon explicitness in description herein, the handle locking device of the invention that is assembled on the outer side surface 103*a* at the right side of the breaker is marked with 20, and correspondingly, the handle locking device of the invention that is assembled on the outer side surface 103*b* at the left side of the breaker is marked with 20'. With reference to FIG. 2 to FIG. 4, at least a pair of preformed holes 101*a*, 101*b* is arranged on the two outer side surfaces 103*a*, 103*b* of the housing of the breaker 10 respectively, the same pair of preformed holes 101*a*, 101*b* is symmetrical with the assembly reference line B of the connection mechanism, and the same pair of elastic barbs 11*a*, 11*b* on the housing base 1 is also symmetrical with the assembly reference line B of the connection mechanism, so that the housing base 1 can be interchangeably mounted on the outer side surface 103*a* or the outer side surface 103*b*. The assembly reference line B is a central line of the sliding member 21 along the height direction Y of the handle locking device after the sliding member 21 is mounted on the housing base 1, and also a central line of the horizontal pivoting door 22 along the height direction Y of the handle locking device after the horizontal pivoting door 22 is mounted on the sliding member 21, thus, the assembly reference line B is naturally formed after the sliding member 21 and the horizontal pivoting door 22 thereon are mounted on the housing base 1. It is not difficult to realize that, the fact that the two preformed holes 101*a*, 101*b* and the two elastic barbs 11*a*, 11*b* are symmetrical with the assembly reference line B of the connection mechanism actually means that the sliding member 21, the horizontal pivoting door 22, the preformed holes 101*a*, 101*b* and the elastic barbs 11*a*, 11*b* are respectively arranged in a manner of being symmetrical with the assembly reference line B, in this way, no matter whether the handle locking device is mounted on the side surface 103*a* at the left side of the breaker 10 or on the side surface 103*b* at the right side of the breaker 10, the positions of the sliding member 21 and the horizontal pivoting door 22 in the width direction X of the breaker 10 are unchangeable, that is to say, the position of the locking mechanism 2 in relation to the handle 102 in the width direction X of the breaker 10 is unchangeable, so as to achieve the purpose that the handle locking device can be interchangeably mounted on the side surface 103*a* at the left side of the breaker 10 or on the side surface 103*b* at the right side of the breaker 10.

With reference to the first implementation mode of the handle locking device for modularized terminal electric appliance in accordance with the invention, as shown in FIG. 1 to FIG. 7 and FIG. 14 to FIG. 21, two different locking modes of the handle locking device can be selectively realized by switching the position structure of the preformed holes 101*a*, 101*b*, the elastic barbs 11*a*, 11*b* of the connection mechanism and the axis O of a rotary shaft 101 of the handle 102: the first locking mode is a single locking mode with OFF state locking or ON state locking only; and the other one is a locking mode that is compatible with OFF state locking and ON state locking. In case of the first locking mode with OFF state locking only, the mounting position of the locking mechanism 2 in relation to the breaker 10 only needs to meet the demand on locking fit between the locking mechanism 2 and the handle 102 of the breaker 10 under the OFF state; but in case of the second locking mode that is compatible with OFF state locking and ON state locking, the mounting position of the locking mechanism 2 in relation to the breaker 10 needs to meet not only the demand on locking fit between the locking mechanism 2 and the handle 102 of the breaker 10 under the OFF state, but also the demand on locking fit between the locking mechanism 2 and the handle 102 of the breaker 10 under the ON state. Therefore, the position structure scheme below needs to be employed in case of the second locking mode: the sliding member 21 is symmetrical with the assembly reference line B, the assembly reference line B and the axis O (as shown in FIG. 21) of the rotary shaft 101 of the handle 102 of the breaker 10 intersect so that the handle locking device is compatible with OFF state locking or ON state locking. It is not difficult to realize that, intersection of the assembly reference line B and the axis O of the rotary shaft 101 of the handle 102 is based practically on the position structure feature that the OFF and ON positions of the inherent handle 102 of the breaker 10 are symmetrical with the axis O, so that the OFF and ON positions of the handle 102 are symmetrical with the assembly reference line B, in this way, the sliding member 21, the first side edge 221*a* and the second side edge 221*b* on the horizontal pivoting door 22, and the OFF and ON positions of the handle 102 are symmetrically arranged in relation to the assembly reference line B respectively, so the first side edge 221*a* on the horizontal pivoting door 22 is in contact fit with the handle 102 under the OFF state (as shown in FIG. 1 and FIG. 7) and the second side edge 221*b* on the horizontal pivoting door 22 is in contact fit with the handle 102 under the ON state (not shown in the drawings), thus realizing the compatibility of the handle locking device with OFF state locking or ON state locking. On condition that the sliding member 21 is at the hiding position, the external dimension of the handle locking device for the breaker 10 in the height direction Y and the width direction X is equal to or less than the dimension of unified regulations in modularized standard. A product, which is based on the handle locking device of the invention having three different mounting modes and/or two different locking modes above, is extensively applicable for a variety of modularized terminal electric appliances, including breaker, isolation (isolator) switch, fuse, power leakage module, accessory (auxiliary, under-voltage, shunt, etc.) units and the like.

In practice, if the operation handles of some breakers are locked under the ON state, their fault tripping will be affected, and in accordance with the second embodiment of the handle locking device for modularized terminal electric appliance as shown in FIG. 8 to FIG. 13, the locking device can be additionally provided with a lug 220 on the horizontal pivoting door of the locking mechanism so as to achieve the function of forbidding ON state locking, and this is suitable for modularized terminal electric appliances that forbid ON state locking. Specifically, with reference to FIG. 8 to FIG. 13, the lug 220 is arranged on the second side edge 221*b* of the horizontal pivoting door 22 of the locking device, a recess 220*a* for receiving the lug 220 is arranged on one side edge of the rectangular groove of the door hole 211 of the sliding member 21, and the lug 220 enters the recess 220*a* completely on condition that the horizontal pivoting door 22 is folded and returned into the door hole 211, so that the horizontal pivoting door 22 does not interfere with sliding of the sliding member 21. With reference to the second implementation mode of the handle locking device for modularized terminal electric appliance in accordance with the invention, the lug 220 is additionally arranged on the second side edge 221*b* of the horizontal pivoting door 22 to result in asymmetry between the second side edge 221*b* and the lug 220 thereon, and the first side edge 221*a*, so the aforementioned structure scheme that the preformed holes 101*a*, 101*b* and the elastic barbs 11*a*, 11*b* are symmetrical with the assembly reference line B of the connection mechanism cannot be employed for the handle locking device in the second embodiment, that is to say, the mounting mode that the handle locking device can be interchangeably mounted on the left outer side surface 103*a* or the right outer side surface 103*b* of the breaker 10 cannot be realized in the second embodiment. In the second embodiment featured by arrangement of the lug 220, the function of forbidding handle locking on modularized terminal electric appliance under the ON state is enhanced, therefore, the structure of the lug 220 cannot be used in the first embodiment, however, the sliding member 21 in the second embodiment as shown in FIG. 12 can be applicable for the first embodiment because the recess 220*a* on the sliding member 21 is specially used for receiving the lug 220.

The state locking device for modularized terminal electric appliance in accordance with the invention is not limited to the description in the embodiments as shown in the drawings. Abundant product serial modes of the handle locking device for modularized terminal electric appliance in accordance with the invention can be realized by selecting the aforementioned position structure scheme regarding mounting mode, or the aforementioned position structure scheme regarding locking mode, or the aforementioned shape structure scheme regarding the ON-state-locking-forbidding lug 220, and its functions may include: having the OFF state locking function only and forbidding locking operation under the ON state; being compatible with the functions of OFF state locking and ON state locking; being assembled on a single side surface (outer side surface 103*a* at the left side or the outer side surface 103*b* at the right side) only; and being compatible with assembly on double side surfaces, and the like. However, all the parts in various modes of products are common except that the position of the elastic barbs 11*a*, 11*b* of the housing base and the shape of the horizontal pivoting door 22 needs to determined.

The invention claimed is:

1. A handle locking device for a modularized terminal electric appliance, comprising a housing base fixedly mounted on one outer side surface of the housing of the modularized terminal electric appliance through a connection mechanism, also comprising a locking mechanism and a padlock, wherein:

the locking mechanism comprises a sliding member on which a door hole and a padlock hole that are mutually penetrative are arranged, the door hole is internally provided with a horizontal pivoting door and a vertical pivoting door which can both be unfolded or folded, when unfolded, the horizontal pivoting door mates with a handle of the modularized terminal electric appliance to block the reverse motion of the handle, the vertical pivoting door and the horizontal pivoting door can mate to block the reverse motion of the unfolded horizontal pivoting door, the horizontal pivoting door is pivotally connected to the sliding member through a horizontal pivoting, the axis K1 of the horizontal pivoting is vertical to the height direction Y of the modularized terminal electric appliance, the vertical pivoting door is pivotally connected to the sliding member through a vertical pivoting, the axis K2 of the vertical pivoting is parallel with the height direction Y of the modularized terminal electric appliance, the padlock is provided with a lock ring which can penetrate through the door hole from the padlock hole and the lock ring can mate with the vertical pivoting door to block the reverse motion of the unfolded vertical pivoting door;

wherein the locking mechanism is connected and mounted with the housing base through a moving pair mechanism, so that the locking mechanism can only perform up/down sliding along the direction of an assembly reference line B parallel to the height direction Y of the modularized terminal electric appliance, and the locking mechanism is defined by a limiting mechanism to slide merely between a corresponding locking working position subsequent to up sliding and a corresponding unlocking hiding position subsequent to down sliding, so that the lock mechanism, by way of the shift of the sliding member, allows the horizontal pivoting door and the vertical pivoting door to be unfolded or both returned into the door hole and realizes adjustable height position of the locking device under the two states of handle locking and unlocking.

2. The handle locking device of claim 1, wherein the moving pair mechanism comprises a pair of sliders formed on the sliding member and a pair of sliding grooves formed on the housing base, the sliders and the sliding grooves creates movable connection in the form of moving pair; or the moving pair mechanism comprises a pair of sliders formed on the house base and a pair of sliding grooves formed on the sliding member, the sliders and the sliding grooves creates movable connection in the form of moving pair.

3. The handle locking device of claim 1, wherein the limiting structure comprises a groove hole formed on the housing base and a sliding pin fixedly connected with the sliding member, the sliding pin is mounted in the groove hole and is in slide fit with the groove hole, the groove hole comprises an upper limiting surface and a lower limiting surface, the sliding member is defined at the working position subsequent to up sliding by the contact blocking of the upper limiting surface and the sliding pin, and the sliding member is defined at the hiding position subsequent to down sliding by the contact blocking of the lower limiting surface and the sliding pin; or the limiting structure comprises a groove hole formed on the sliding member and a sliding pin fixedly connected with the housing base, the sliding pin is mounted in the groove hole and is in slide fit with the groove hole, the groove hole comprises an upper limiting surface and a lower limiting surface, the sliding member is defined at the working position subsequent to up sliding by the contact blocking of the lower limiting surface and the sliding pin, and the sliding member is defined at the hiding position subsequent to down sliding by the contact blocking of the upper limiting surface and the sliding pin.

4. The handle locking device of claim 1, wherein the connection mechanism comprises at least a pair of preformed holes formed on the housing of the modularized terminal electric appliance, at least a pair of elastic barbs formed on the housing base, the housing base is fixedly mounted on the outer side surface of the housing of the modularized terminal electric appliance by clamping fit of the elastic barbs and the preformed holes.

5. The handle locking device of claim 1, further comprising a positioning mechanism, the positioning mechanism comprises at least a pair of positioning notches and at least a pair of elastic protrusions, and when the sliding member is at the hiding position or the working position, the same pair of elastic protrusions respectively enters the same pair of positioning notches and comes into elastic contact with the two positioning notches, so that the sliding member is defined at the hiding position or the working position and fails to slide freely;

wherein the positioning notches are formed on the sliding member and the elastic protrusions are formed on the housing base, or the positioning notches are formed on the housing base and the elastic protrusions are formed on the sliding member.

6. The handle locking device of claim 1, wherein the sliding member comprises a stepped plate-shaped body, which is formed by a first surface as well as a second surface parallel with the first surface and a third surface, and further comprises the periphery of the plate-shaped body, which is formed by closed connection of two parallel long side surfaces and at least two short side surfaces;

the first surface is arranged towards the outer side surface of the modularized terminal electric appliance, the second surface is parallel with and lower than an outer surface of the housing base, and the third surface is arranged towards an inner surface of the housing base;

the door hole is provided with a rectangular groove which is arranged on the plate-shaped body formed by the first surface and the second surface, the opening of the groove is connected with the first surface, the bottom surface of the groove is connected with the second surface, the padlock hole is arranged on the bottom surface of the groove and penetrates through the groove, and a horizontal pivoting hole connected with the horizontal pivoting of the horizontal pivoting door and a vertical pivoting hole connected with the vertical pivoting of the vertical pivoting door are arranged on the side frame of the door hole respectively;

a pinhole is formed on the plate-shaped body formed by the first surface and the third surface, and the pinhole is fixedly connected with the sliding pin of the limiting mechanism; or, the groove hole is formed on the plate-shaped body formed by the first surface and the third surface, and the groove hole is in slide fit with the sliding pin of the limiting mechanism;

a pair of sliders or a pair of sliding grooves are arranged at the upper parts of the two long side surfaces, the sliders are in slide fit with a pair of sliding grooves on the housing base; or the sliding grooves are in slide fit with a pair of sliders on the housing base; and at least a pair of positioning grooves or at least a pair of elastic protrusions are arranged on the two long side surfaces.

7. The handle locking device of claim 1, wherein the sum of the thicknesses of the horizontal pivoting door and the vertical pivoting door is less than or equal to the depth of the door hole; and the padlock hole is arranged towards the vertical pivoting door.

8. The handle locking device of claim 4, wherein the sliding member is arranged to be symmetrical with the assembly reference line B of the handle locking device, each pair of preformed holes on the two outer side surfaces of the modularized terminal electric appliance are arranged to be symmetrical with the assembly reference line B, each pair of elastic barbs on the housing base are also arranged to be symmetrical with the assembly reference line B, so that the housing base can be interchangeably mounted on the outer side surface or the outer side surface of the housing of the modularized terminal electric appliance.

9. The handle locking device of claim 6, wherein a lug is arranged on a second side edge of the horizontal pivoting door, a recess is arranged on one side edge of the rectangular groove of the door hole of the sliding member, the recess is used for receiving the lug, and the lug enters the recess completely on condition that the horizontal pivoting door is folded and returned into the door hole.

10. The handle locking device of claim 9, wherein the sliding member is arranged to be symmetrical with the assembly reference line B of the handle locking device, and the assembly reference line B intersects with the axis O of a rotary shaft of the handle of the modularized terminal electric appliance, so that the OFF and ON positions of the handle are symmetrical with the assembly reference line B.

* * * * *